US007327970B2

(12) United States Patent
Moon

(10) Patent No.: US 7,327,970 B2
(45) Date of Patent: Feb. 5, 2008

(54) PROCESS CARTRIDGE AND IMAGE FORMING DEVICE HAVING THE SAME

(75) Inventor: Ji-won Moon, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/372,055

(22) Filed: Mar. 10, 2006

(65) Prior Publication Data

US 2007/0048016 A1 Mar. 1, 2007

(30) Foreign Application Priority Data

Aug. 26, 2005 (KR) ..... 10-2005-0078988

(51) Int. Cl.
*G03G 21/16* (2006.01)

(52) U.S. Cl. ..... 399/111; 399/116; 399/119; 399/159; 399/167

(58) Field of Classification Search ..... 399/167, 399/111, 159, 116, 119
See application file for complete search history.

(56) References Cited

U.S. PATENT DOCUMENTS

| | | | | |
|---|---|---|---|---|
| 6,714,746 | B2 * | 3/2004 | Morioka et al. | 399/27 |
| 2001/0017994 | A1 * | 8/2001 | Arimitsu et al. | 399/167 |

FOREIGN PATENT DOCUMENTS

| | | | |
|---|---|---|---|
| JP | 09-085991 | | 3/1997 |
| JP | 2000-214654 | | 8/2000 |
| JP | 2000214654 | A * | 8/2000 |
| JP | 2002-296905 | | 10/2002 |
| KR | 100393075 | | 7/2003 |

* cited by examiner

*Primary Examiner*—David M. Gray
*Assistant Examiner*—Geoffrey T Evans
(74) *Attorney, Agent, or Firm*—Roylance, Abrams, Berdo & Goodman, L.L.P.

(57) ABSTRACT

A process cartridge of an image forming device has a photosensitive body unit including a photosensitive body and a photosensitive body driving part. The photosensitive body driving unit has a photosensitive body gear formed on a photosensitive body shaft. An electrostatic latent image is formed on the photosensitive body. A developing unit includes developing roller developing the electrostatic latent image and a developing driving part. The developing driving part has a developing roller gear formed on a developing roller shaft. A housing integrates the photosensitive body unit and the developing unit into a single module. The developing driving part includes a driving member protruding outside of the housing and transmitting a driving force from the outside. The developing roller of the developing unit may be driven only when necessary, and the process cartridge may be mounted to the image forming device body without requiring a coupling device.

18 Claims, 6 Drawing Sheets

PROCESS CARTRIDGE AND IMAGE FORMING DEVICE HAVING THE SAME

CROSS-REFERENCE TO RELATED APPLICATIONS

This application claims the benefit under 35 U.S.C. § 119 (a) of Korean Patent Application No. 2005-78988, filed on Aug. 26, 2005, the entire contents of which are hereby incorporated by reference.

BACKGROUND OF THE INVENTION

1. Field of the Invention

The present invention relates to an electrophotographic image forming device, such as a laser printer, a digital copier, and a facsimile. More particularly, the present invention relates to a process cartridge developing an electrostatic latent image formed on a photosensitive body into a developer image, and an image forming device having the same.

2. Description of the Related Art

Generally, an electrophotographic image forming device, such as a laser printer, a digital copier, and a facsimile, includes a process cartridge integrating a photosensitive body and a developing unit into a single module. The photosensitive body is exposed to a laser to form an electrostatic latent image thereon, and the developing unit supplies developer to the photosensitive body to form a developer image corresponding to the electrostatic latent image. Generally, the process cartridge is detachably mounted in an image forming device body to easily repair all parts of the cartridge.

FIG. 1 is a view of a conventional process cartridge 1 that is detachably mounted in the image forming device body.

The process cartridge 1 includes a photosensitive body 6 that is rotatably disposed in a photosensitive body casing 2.

A developing unit 4 is disposed adjacent to the photosensitive body 6.

The developing unit 4 includes a developing casing 8 formed integrally with or detachably from the photosensitive body casing 2. A developing roller 12 contacts the photosensitive body 6 with a space therebetween in the developing casing 8. A supply roller 13 supplies developer to the developing roller 12. A developer regulating blade (not shown) contacts the developing roller 12 to regulate the thickness of developer layer.

As shown in FIG. 2, a photosensitive body gear 6*a* formed on a photosensitive body shaft 6*b* is connected through an idle gear 10 and a retardation gear 11 with a developing roller gear 12*a* and a supply roller gear 13*a* in the developing casing 8. The photosensitive body gear 6*a* is also meshed with a driving gear 5 of a gear train connected with a driving motor (not shown) mounted in the image forming device body as the process cartridge 1 is mounted in the image forming device body.

Accordingly, as the process cartridge 1 is mounted in the image forming device body and the driving motor is driven, the photosensitive body gear 6*a* is rotated in a certain direction, such as clockwise, by the driving gear 5. As the photosensitive body gear 6*a* rotates clockwise, the photosensitive body 6, formed coaxially with the photosensitive body gear 6*a*, also rotates clockwise.

The rotating force of the photosensitive body gear 6*a* is transmitted through the idle gear 10 and the retardation gear 11 to the developing roller gear 12*a* and the supply roller gear 13*a*, and accordingly, each of the developing roller 12 and the supply roller 13 is rotated counterclockwise.

However, in the conventional process cartridge 1 with the above structure, the developing roller 12 and the supply roller 13 of the developing unit 4 are rotated with the photosensitive body 6 by the idle gear 10, the retardation gear 11, the developing roller gear 12*a*, and the supply roller gear 13*a*. Therefore, when the electrostatic latent image is not developed, for example, when the photosensitive body 6 idly rotates, the developing roller 12 and the supply roller 13 rotate together with the photosensitive body 6. The unnecessary rotating of the developing roller 12 and the supply roller 13 increases the developer stress because friction force is generated between the developing roller 12 and the supply roller 13, and between the developing roller 12 and the developer regulating blade. The increase of developer stress results in a decrease of development uniformity and image quality.

Additionally, the developing roller 12 and the supply roller 13 are connected with a plurality of gears, such as the idle gear 10, the retardation gear 11, the developing roller gear 12*a*, and the supply roller gear 13*a*. Therefore, when the velocity ratio between the photosensitive body 6 and the developing roller 12 is adjusted to control the developing capability, the velocity ratio cannot be easily adjusted because of the number of gear tooth and the adjustment of distances between shafts of gears.

To solve the above problem, a process cartridge (not shown) is introduced and used in which the idle gear 10 is omitted between the photosensitive body gear 6*a* and the retardation gear 11, and the driving force transmitted from a separate driving motor (30, referring to FIG. 3) is transmitted to a developing roller shaft 12*b* so that the developing roller 12 and the supply roller 13 of the developing unit 4 are driven separately from the photosensitive body 6.

As shown in FIG. 3, the process cartridge has the developing roller gear 12*a* formed in the developing casing 8, and therefore, a coupling device 10 is required for coupling a driving shaft 30*a* of the driving motor 30 and the developing roller shaft 12*b* formed in the developing casing 8 to transmit the driving force of the driving motor 30 to the developing unit 4.

The coupling device 10 includes a protrusion portion 17*a*, a recess 18*a*, and an elastic spring 21. The protrusion portion 17*a* is configured at a first coupling shaft 17 formed at a drum flange 16 of the developing roller shaft 12*b* to be coaxially formed with the developing roller gear 12*a*, and has a certain shape, such as a triangular shape. The recess 18*a* of a triangular shape is configured at a second coupling shaft 18 of a rotation member 15 to receive the protrusion portion 17*a*. The elastic spring 21 is formed at an image forming device body to elastically pressurize the second coupling shaft 18 to the first coupling shaft 17 so that the protrusion portion 17*a* can be coupled with the recess 18*a*.

The rotation member 15 receives a driving force through a driven gear 34, which is meshed with a driving gear 20 of a driving shaft 30*a* of the driving motor 30, from the driving motor 30.

However, the coupling device 10 has a complicated operation, in which the protrusion portion 17*a* is fitted in the recess 18*a* as the cartridge is mounted, and requires a plurality of parts. Therefore, the manufacturing costs increase.

Additionally, when the developing roller shaft 12*b* engaged in the developing casing 8 is not stably coupled with the driving shaft 30*a* of the driving motor 30, the driving force may be inferiorly transmitted or not transmitted to the developing roller 12 and the supply roller 13 of the developing unit 4.

Accordingly, a need exists for an image forming device having an improved process cartridge in which developer stress is substantially prevented, such that image quality does not substantially deteriorate due to developer stress.

SUMMARY OF THE INVENTION

Accordingly, an object of the present invention is to provide a process cartridge that drives a developing unit when necessary and may be mounted in an image forming device body without requiring a coupling device, which increases the complexity and cost of manufacturing, and an image forming device having the same.

A process cartridge of an image forming device includes a photosensitive body unit having a photosensitive body and a photosensitive body driving part. The photosensitive body driving unit has a photosensitive body gear formed on a photosensitive body shaft, an electrostatic latent image being formed on the photosensitive body, a developing unit including a developing roller developing the electrostatic latent image and a developing driving part. The developing driving part has a developing roller gear formed on a developing roller shaft, and a housing integrating the photosensitive body unit and the developing unit into a single module. The developing driving part includes a driving member protruding outside of the housing and transmitting a driving force from the outside.

The driving member includes a gear formed on the developing roller shaft protruding to the outside of the housing and meshed with a first driving gear connected with a first driving motor of the outside. The developing roller shaft may be fixed at the housing by a supporting bracket.

The photosensitive body gear is arranged to be meshed with a second driving gear connected with the first driving motor or a second driving motor. The photosensitive body gear may be connected with the developing driving part by at least one idle gear.

An image forming device includes a image forming device body having a first driving gear connected with a first driving motor. A process cartridge includes a photosensitive body unit having a photosensitive body and a photosensitive body driving part. The photosensitive body driving unit has a photosensitive body gear formed on a photosensitive body shaft, an electrostatic latent image being formed on the photosensitive body, a developing unit including a developing roller developing the electrostatic latent image and a developing driving part. The developing driving part has a developing roller gear formed on a developing roller shaft, and a housing integrating the photosensitive body unit and the developing unit into a single module. The developing driving part includes a driving member protruding outside of the housing and being meshed with the first driving gear as the process cartridge is mounted to the image forming device body.

The driving member includes a gear formed on the developing roller shaft protruding outside of the housing and meshed with the first driving gear. The developing roller shaft may be fixed at the housing by a supporting bracket.

The photosensitive body gear is arranged to be connected with a second driving gear transmitting a driving force from the first driving motor or a second driving motor. The photosensitive body gear may be connected with the developing driving part by at least one idle gear.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above aspects and features of the present invention will be more apparent by describing certain exemplary embodiments of the present invention with reference to the accompanying drawings, in which.

Throughout the drawings, the same drawing reference numerals will be understood to refer to the same elements, features, and structures.

DETAILED DESCRIPTION OF THE EXEMPLARY EMBODIMENTS

Exemplary embodiments of the present invention are described in detail with reference to the annexed drawings. In the following description, detailed descriptions of known functions and configurations incorporated herein have been omitted for conciseness and clarity.

Figure 1:
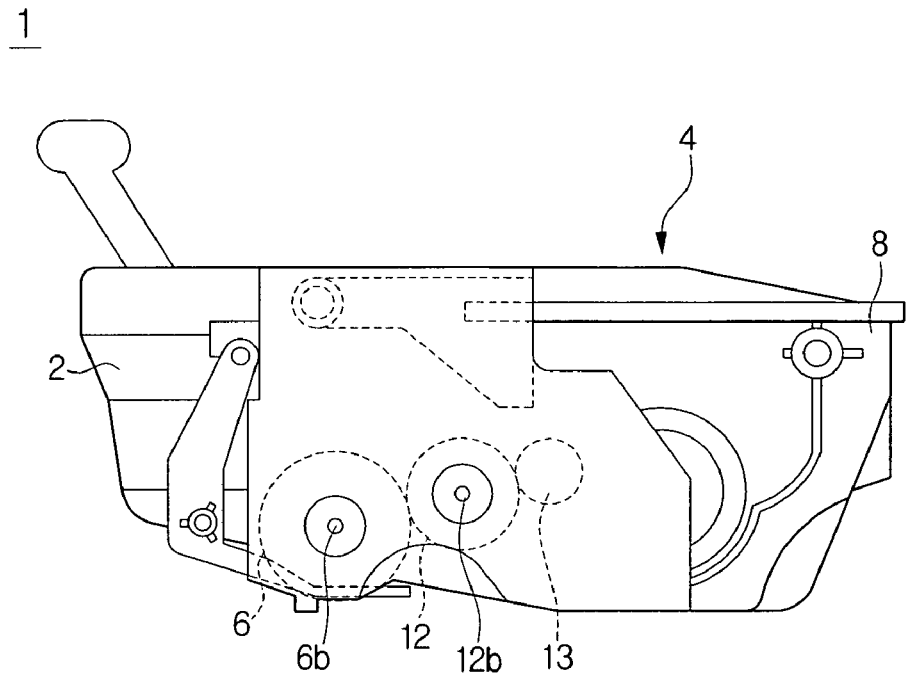
FIG. 1 (PRIOR ART)
FIG. 1 is a side view of a conventional process cartridge of an image forming device.
Figure 2:
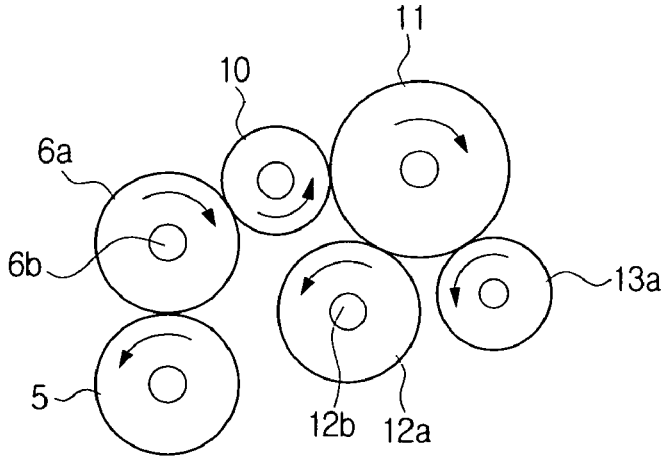
FIG. 2 (PRIOR ART)
FIG. 2 is a schematic view of a driving part of the process cartridge of FIG. 1.
Figure 3:
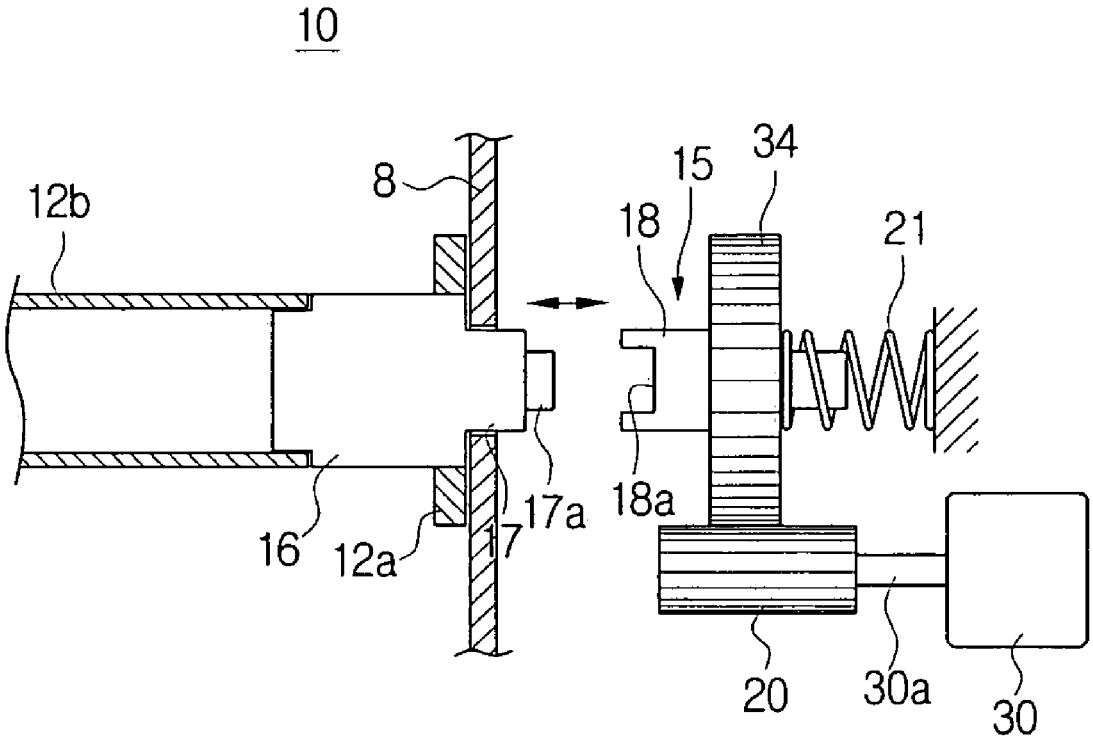
FIG. 3 (PRIOR ART)
FIG. 3 is an elevational view in partial cross section of a coupling device for coupling a developing roller shaft of another conventional process cartridge with a driving shaft of a driving motor of an image forming device body.
Figure 4:
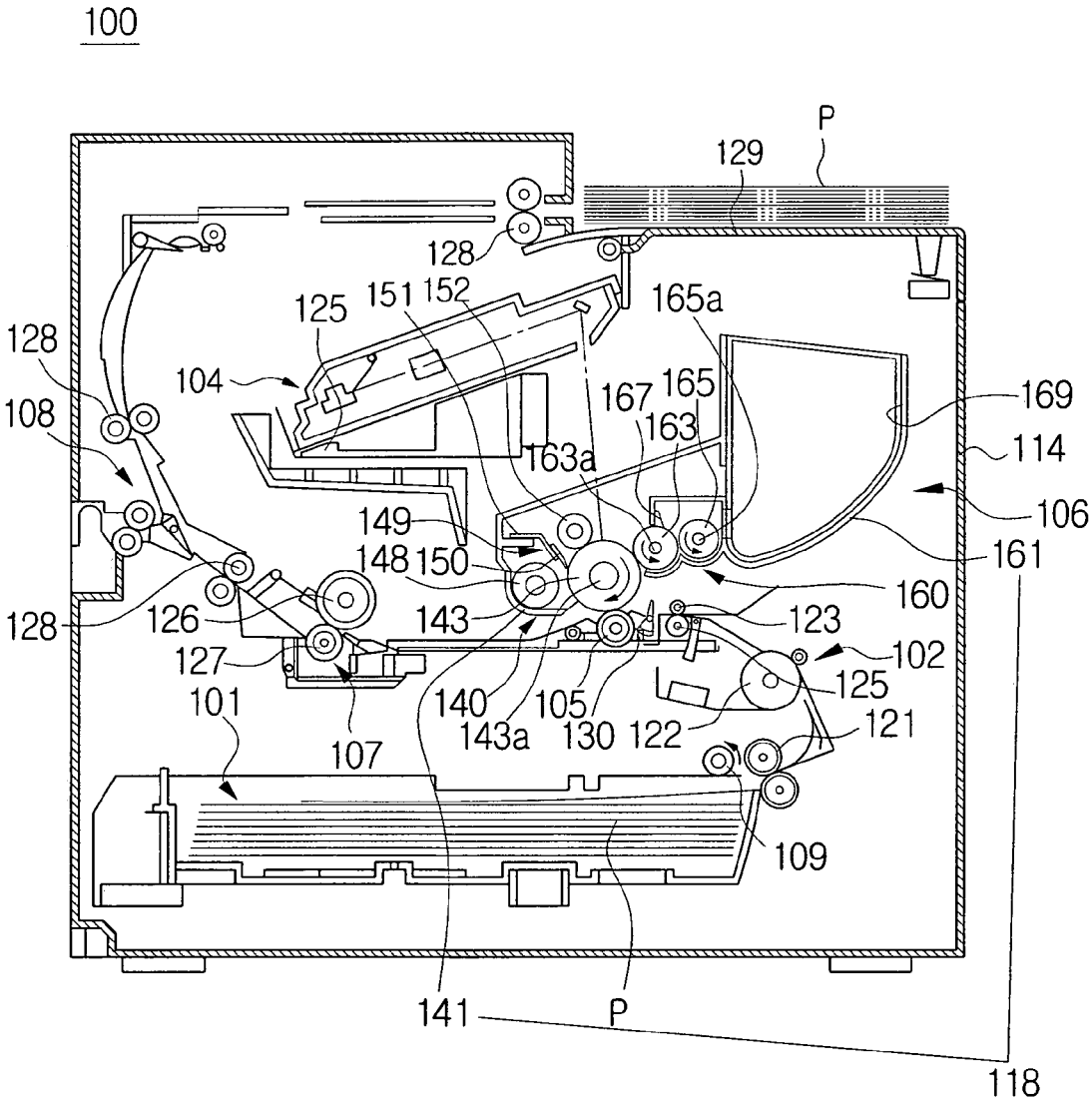
FIG. 4 is a schematic view of a laser printer having a process cartridge according to an exemplary embodiment of the present invention.

FIG. 4 is a schematic view of an image forming device having a process cartridge according to an exemplary embodiment of the present invention.

The image forming device according to an exemplary embodiment of the present invention is a laser printer 100 that prints and outputs data input from an external device, such as a personal computer (PC).

The laser printer 100 includes a stack unit 101 stacking papers P, a feeding unit 102 feeding the paper P from the stack unit 101. A process cartridge 106 forms a developer image on the paper P fed by the feeding unit 102. A fixing unit 107 fixes the developer image on the paper P with heat and pressure. A discharge unit 108 discharges the paper P fixed with the developer image.

The stack unit 101 includes a paper feeding cassette, which has a paper press board elastically supported by an elastic spring to elastically lift and lower the paper P.

The feeding unit 102 includes a pick-up roller 109 for feeding the paper P by a sheet from the stack part 101. First and second feeding rollers 121 and 122 feed the paper P fed from the pick-up roller 109. A register and back-up rollers 123 and 125 align a leading end of the paper P fed from the first and the second feeding rollers 121 and 122.

A paper sensor 130 is disposed at a rear side, that is, downstream, in a paper feeding path of the register roller 123 to sense a position of the leading end of the paper P.

The process cartridge 106 includes a photosensitive body unit 140, a developing unit 160, and a housing 118 integrally forming the photosensitive body unit 140 and the developing unit 160 into a single module to detachably mount the photosensitive body unit 140 and the developing unit 160 in the image forming device body 114.

Figure 6:
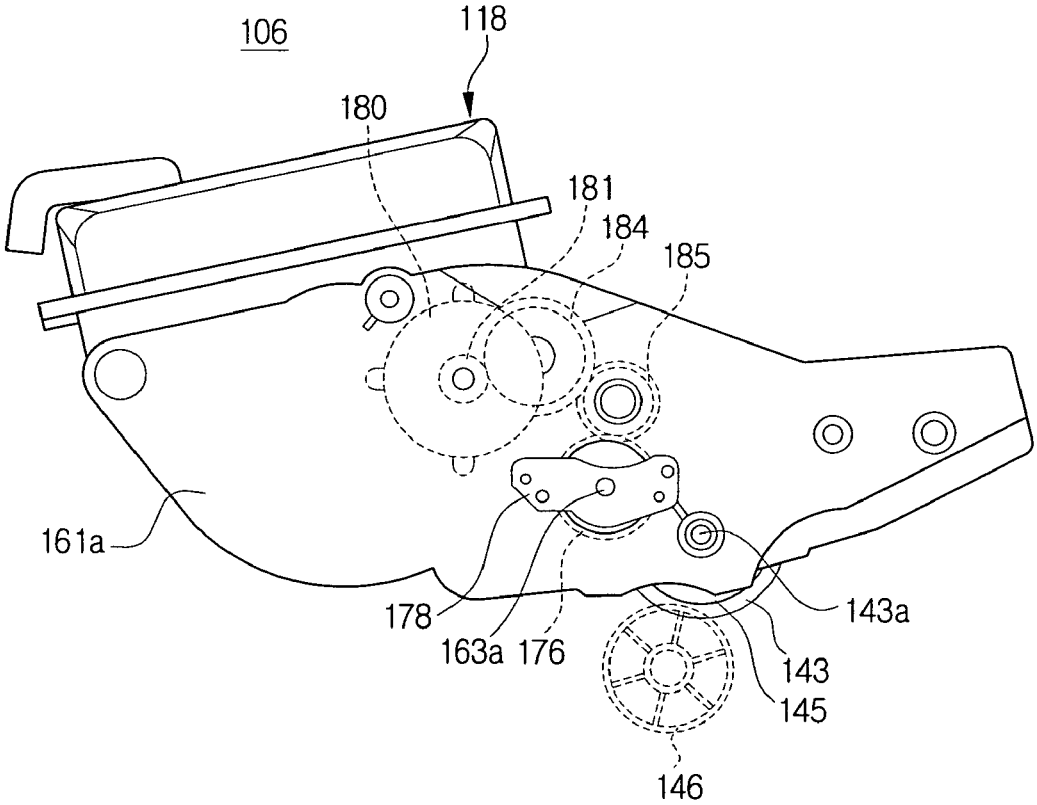
FIG. 6 is a right side elevational view of the process cartridge of FIG. 5.
Figure 7:
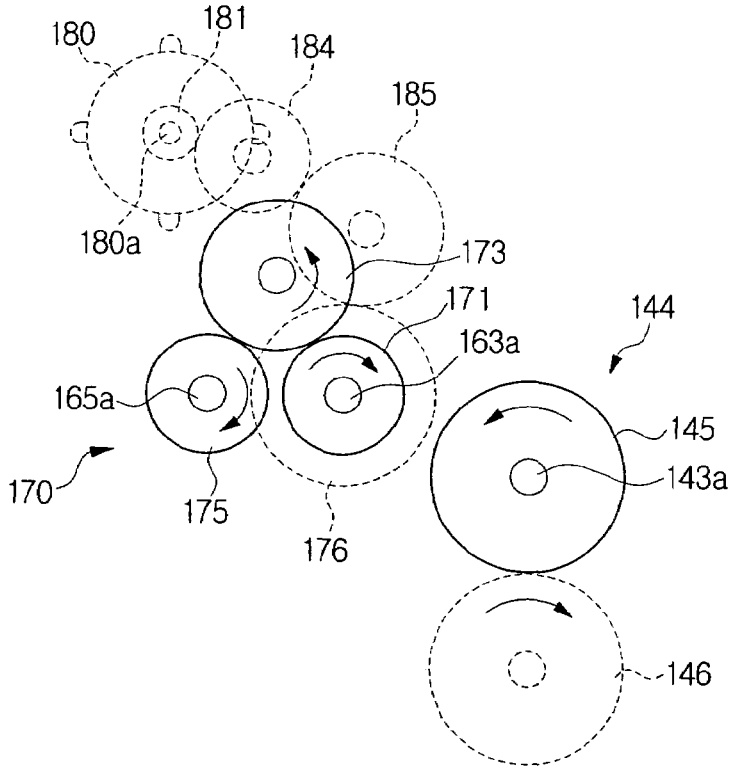
FIG. 7 is a schematic view of a photosensitive body driving part of a photosensitive body unit and a developing driving part of a developing unit of the process cartridge of FIG. 5.

The photosensitive body unit 140 includes a photosensitive body 143. Opposite ends of the photosensitive body 143 are rotatably supported by a photosensitive body casing 141. The photosensitive body 143 includes an organic As shown in FIGS. 6 and 7, a photosensitive body gear 145 is formed at one side of a photosensitive body shaft 143*a* in the photosensitive body casing 141 to operate as a photosensitive driving part 144. The photosensitive body gear 145 is meshed with a second driving gear 146 of a photosensitive body gear train (not shown) to receive a driving force from a photosensitive body driving motor (not shown) provided in the image forming device body 114 as the process cartridge 104 is mounted to a fixing frame (not shown) of the image forming device body 114. The photosensitive body 143 is rotated in a certain direction, for example, a clockwise direction (refer to FIG. 4; a counterclockwise direction as shown in FIG. 6 and FIG. 7) by the second driving gear 146 of the photosensitive gear train. The construction of the photosensitive body gear train is substantially similar to generally well-known photosensitive body gear train constructions, and therefore, the detailed description thereof is omitted for the sake of brevity.

In an exemplary embodiment of the present invention, the second driving gear 146 receives the driving force through the photosensitive body gear train from the photosensitive body driving motor. However, such configuration should not be considered as limiting. The second driving gear 146 may receive the driving force through a separate gear train (not shown) from a developing driving motor 180, which will be explained later.

Referring back to FIG. 4, a charge eraser 148, a photosensitive body cleaner 149, and a charger 152 are arranged in the rotation direction of the photosensitive body 143 adjacent to an outer circumference of the photosensitive body 143.

The charge eraser 148, which removes the potential charged on the photosensitive body 143, includes a charge erasing lamp.

The photosensitive body cleaner 149, which removes a waste developer remaining on the surface after a developer image is formed on the photosensitive body 143 by the developing unit 160 and is transferred onto a paper P by a transfer roller 105, includes a cleaning member 150 such as a cleaning blade.

The cleaning member 150 is attached to a fixing bracket 151 formed in the photosensitive body casing 141 to contact the photosensitive body 143 with a certain pressure.

The charger 152 includes a charging roller disposed to contact the surface of the photosensitive body 143. A certain charge bias power is supplied to the charger 152 by a charge bias power part (not shown) to form a certain charge potential on the surface of the photosensitive body 143.

The developing unit 160 includes a developing roller 163 arranged to oppose the photosensitive body 143 with a certain gap in a developing casing 161. A supply roller 165 supplies developer to the developing roller 163. A developer regulating blade 167 regulates a thickness of a developer layer stuck on the developing roller 163. A developer storage part 169 stores the developer.

The developing roller 163 sticks the developer onto an electrostatic latent image, which is formed on the photosensitive body 143 by a laser scanning unit (LSU) 104, to develop the latent image. The developing roller 163 is opposed to the photosensitive body 143 with a gap therebetween. The developing bias power part (not shown) supplies a certain developing bias power to the developing roller 163 lower than that to the supply roller 165.

The supply roller 165, supplying the developer to the developing roller 163 by using the potential difference between the supply roller 165 and the developing roller 163, is arranged to contact one side of the developing roller 163 and to form a nip therebetween. The developer is conveyed to a lower space between the supply roller 165 and the developing roller 163 by the supply roller 165 in the developing casing 161.

The developer supply bias power part (not shown) supplies a certain developer supply bias power to the supply roller 165 higher than that to the developing roller 163. Accordingly, the developer of the lower space between the supply roller 165 and the developing roller 163 is charged by the supply roller 165, and sticks on the developing roller 163 with relatively lower potential and moves to the nip between the supply roller 165 and the developing roller 163.

The developer regulating blade 167 regulates the developer to a certain thickness, which is, for example, a thin layer. The developer is supplied to the developing roller 163 through the supply roller 165.

The developer storage part 169 receives and stores the developer and is detachably provided in the developing casing 161. An agitator (not shown) is disposed in the developer storage part 169 to agitate the stored developer. The construction of the agitator is substantially similar as conventional agitators, and therefore, the detailed description thereof is omitted for the sake of brevity.

As shown in FIG. 7, the developing unit 160 includes a developing driving part 170.

The developing driving part 170 includes a developing roller gear 171 formed on a developing roller shaft 163*a* in the developing casing 161. The developing roller gear 171 is meshed with a retardation gear 173, opposite ends of which are supported to be capable of rotating in the developing casing 161. The retardation gear 173 is meshed with a supply roller gear 175 formed on a supply roller shaft 165*a*.

Figure 5:
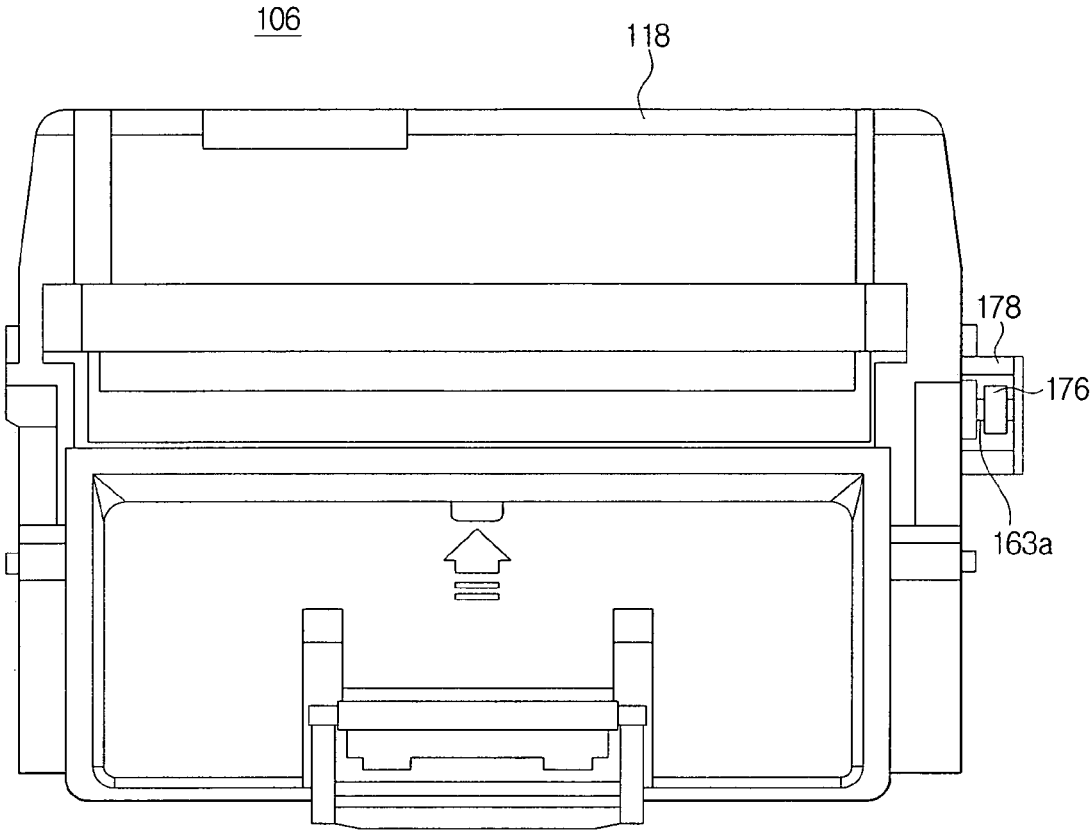
FIG. 5 is a top plan view of the process cartridge of FIG. 4.

As shown in FIGS. 5 and 6, the developing driving part 170 includes a driving member 176 formed on the developing roller shaft 163*a* that protrudes outside of one side wall 161*a* of the developing casing 161.

The driving member 176 moves in association with the first driving gear 185, which is connected through a driving force transmission gear 184 to a motor gear 181 formed on a driving shaft 180*a* of a developing driving motor 180 and of the image forming device body 114, as the process cartridge 106 is mounted to the fixing frame (not shown) of the image forming device body 114. The driving member 176 may be composed of a gear meshed with the first driving gear 185 by the upper portion thereof.

An end portion of the developing roller shaft 163*a*, on which the driving member 176 is formed, is supported by a supporting bracket 178. The supporting bracket 178 is fixed at the one side wall 161*a* of the developing casing 161 of the housing 118 by a fixing means (not shown), such as a screw, so that the gap between the developing roller 163 and the photosensitive body 143 may be easily adjusted, if necessary, to enhance the developing capability.

The supporting bracket 178 allows the gap between the developing roller 163 and the photosensitive body 143 to be easily adjusted, and further restricts a load torque of the developing roller shaft 163*a* regarding the rotating force of the first driving gear 185 to prevent the movement of the developing roller shaft 163*a* such that the gap between the photosensitive body 143 and the developing roller 163 may be maintained as set. Accordingly, deterioration of print images, such as by jittering, may be minimized that are generated by changes in the gap distance between the photosensitive body 143 and the developing roller 163.

Accordingly, as the process cartridge 106 is mounted to the fixing frame of the image forming device body 114, the driving member 176 is meshed with the first driving gear 185 formed in the image forming device body 114.

As a result, the rotating force of the first driving gear 185 is transmitted through the driving member 176 to the developing roller shaft 163*a,* and the developing roller 163 is rotated in a direction of meshing with the photosensitive body 143, that is, a counterclockwise direction as shown in FIG. 4 and a clockwise direction as shown in FIGS. 6 and 7.

The rotating force transmitted to the driving member 176 is transmitted through the developing roller gear 171, which is formed coaxially with the developing roller shaft 163*a,* and the retardation gear 173 to the supply roller gear 175. As a result, the supply roller 165 is rotated in a direction opposite the developing roller 163, that is, a counterclockwise direction as shown in FIG. 4 and a clockwise direction as shown in FIGS. 6 and 7).

The process cartridge 106 according to an exemplary embodiment of the present invention further includes the developing driving part 170 separate from the photosensitive body driving part 144 driven by the photosensitive body driving motor, to drive only the developing roller 163 and the supply roller 165 of the developing unit 160, when necessary. Therefore, an increase of the developer stress may be substantially prevented, which is caused by the friction force generated between the developing roller 12 and the supply roller 13 and between the developing roller 12 and the developer regulating blade in the conventional process cartridge 1. The friction force is generated as the developing roller 12 and the supply roller 13 are unnecessarily rotated. The prevention of an increase of the developer stress results in substantially preventing the degradation of image quality due to the lowering of the development uniformity.

The process cartridge 106 according to an exemplary embodiment of the present invention includes the driving member 176 that protrudes outside of one side wall 161*a* of the developing casing 161 and is meshed with the first driving gear 185 formed in the image forming device body 114. Therefore, the process cartridge 106 may be easily mounted to the fixing frame of the image forming device body 114 without requiring a dedicated coupling device that is complicated and increases the manufacturing costs.

Referring to FIG. 4, the LSU 104 is fixed at a fixing bracket 125 above the process cartridge 106. The LSU 104 emits a laser beam onto the surface of the photosensitive body 143, which is charged with a certain potential by the charger 152, by using a laser diode according to image signals input from an external device, such as a personal computer. Therefore, an electrostatic latent image may be formed that has a certain potential lower than a charged potential.

The transfer roller 105 is arranged under the photosensitive body 143 of the process cartridge 106.

The transfer roller 105, which transfers the developer image formed on the photosensitive body 143 onto the paper P, pressurizes the photosensitive body 143 with a certain pressure. A certain transfer bias power is supplied to the transfer roller 105 by the transfer bias power part (not shown) so that the developer image formed on the photosensitive body 143 may be transferred onto the paper P.

The fixing part 107 includes a heating roller 126 that heats the developer image, which is transferred from the photosensitive body 143 onto the paper P, and a press roller 127 pressurizing the developer image.

The discharge unit 108 includes a discharge roller 128 discharging the printed paper P, and a stack 129 stacking and supporting the discharged paper P.

In the process cartridge 106 of the laser printer 100 according to an exemplary embodiment, the photosensitive body unit 140 is driven independently from the developing unit 160 by the photosensitive body driving part 144. However, such configuration should not be considered as limiting.

Figure 8:
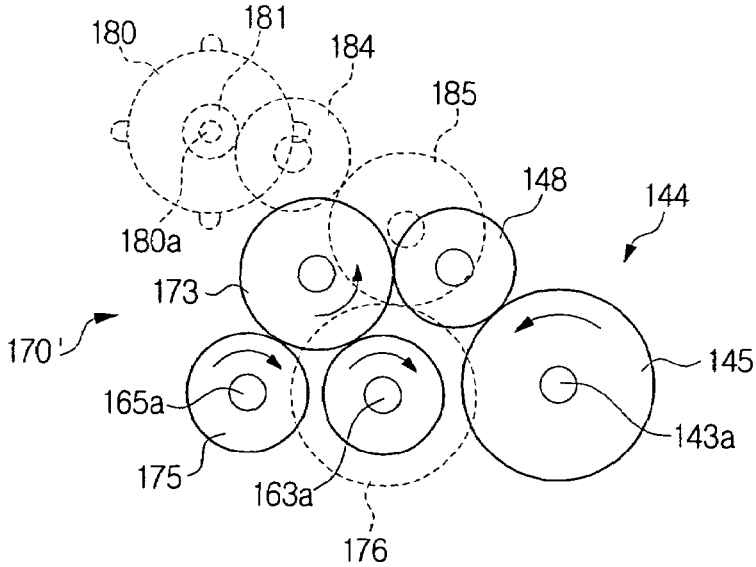
FIG. 8 is a schematic view of another exemplary embodiment of a photosensitive body driving part of a photosensitive body unit and a developing driving part of a developing unit of the process cartridge of FIG. 4.

As shown in FIG. 8, the photosensitive body unit 140 may be formed to be driven by a developing driving part 170' instead of the photosensitive body driving motor formed in the image forming device body 114. The photosensitive body driving motor and the photosensitive body gear train are omitted, and the developing driving part 170' further includes an idle gear 148 disposed between the photosensitive body gear 145 and the retardation gear 173. Accordingly, the rotating force of the developing driving motor 180 transmitted via the driving member 176 to the developing roller shaft 163*a* may be transmitted through the retardation gear 173 and the idle gear 148 to the photosensitive body gear 145.

The operation of the laser printer 100 having the process cartridge 106 according to an exemplary embodiment of the present invention is explained with reference to FIGS. 4 through 7.

As a print command on a document is input from the external device, such as personal computer, a control part (not shown) of the printer 100 drives the pick-up roller 109 so that the uppermost paper P in the stack unit 101 is picked up by the pick-up roller 109 and fed to the register roller 123 by the first and the second feeing rollers 121 and 122.

The leading end of the paper P, which is fed to the register roller 124, is pressed and aligned by the nip between the register roller 123 and the back up roller 125.

Then, as the paper P passes the nip between the register roller 123 and the back up roller 125 and continues to move, the leading end of the paper P operates the paper sensor 130 between the register roller 123 and the register roller 105. The paper sensor 130 sends a paper sensing signal to the control part.

The control part counts the moving time of paper P from the paper sensor 130 to the transfer roller 105 according to the paper sensing signal, and after feeding the paper P during the preset required time arriving at the printing start position, operates the process cartridge 106 and the transfer roller 105.

While the paper P is fed to the printing start position, an electrostatic latent image is formed on the photosensitive body 143 of the process cartridge 106 by the laser beam emitted from the LSU 104 according to the image signal. The electrostatic latent image formed on the photosensitive body 143 is developed into a visible developer image by the developing roller 163.

Then, as the paper P arrives at the photosensitive body 143 of the process cartridge 106, the developer image formed on the photosensitive body 143 is transferred onto the paper P by the transfer roller 105 under the control of the control part.

Passing the fixing unit 107, the developer image transferred onto the paper P is fixed on the paper P by the heat and pressure of the heating roller 126 and the press roller 127. The paper P fixed with the developer image is discharged to the stack 129 by the discharge rollers 128 of the discharge unit 108.

Then, the operations of picking up, developing, fixing and discharging the paper P are repeated according to the aforementioned method until all contents of the document are printed.

As described above, the process cartridge according to an exemplary embodiment of the present invention and the image forming device having the same includes the developing driving part that drives the developing roller of the developing unit only when necessary. Therefore, the developer stress may be substantially prevented, which is caused by the friction force generated between the developing roller and the supply roller and between the developing roller and the developer regulating blade. The friction force is generated as the developing roller and the supply roller are unnecessarily rotated in association with the idle rotating of the photosensitive body in the conventional process cartridge. The prevention of developer stress results in substantially preventing the deterioration of image quality due to the lowering of the development regulation.

The process cartridge according to an exemplary embodiment of the present invention and the image forming device having the same includes the driving member that protrudes outside of the developing casing to be meshed with the first driving gear connected with the developing driving motor of the image forming device body. Therefore, the process cartridge may be easily mounted to the image forming device body without requiring the coupling device that is complicated and increases the manufacturing costs.

The process cartridge according to an exemplary embedment of the present invention and the image forming device having the same includes the supporting bracket that supports and fixes the end portion of the photosensitive body shaft forming the driving member thereon. Therefore, the gap between the developing roller and the photosensitive body may be easily adjusted to enhance the developing capability and the load torque of the developing roller shaft is restricted regarding the rotating force of the first driving gear connected with the developing driving motor of the image forming device body. Therefore, the movement of the developing roller shaft is substantially prevented, such that the gap between the photosensitive body and the developing roller may be substantially maintained as set. Accordingly, the deterioration of print image quality, such as by jittering, may be substantially minimized, which is generated depending on changes of the gap between the photosensitive body and the developing roller.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A process cartridge of an image forming device, the process cartridge comprising:

a photosensitive body unit including a photosensitive body; and a photosensitive body driving part, the photosensitive body driving part having a photosensitive body gear on a photosensitive body shaft, and an electrostatic latent image being formed on the photosensitive body;

a developing unit including a developing roller developing the electrostatic latent image; and a developing driving part, the developing driving part having a developing roller gear on a developing roller shaft, the developing roller shaft being fixed at the housing by an adjustable supporting bracket such that a distance between the developing roller and the photosensitive body is adjustable;

a housing integrating the photosensitive body unit and the developing unit into a single module; and a driving member of the developing driving part protruding outside of the housing and transmitting a driving force from the outside.

2. The process cartridge as claimed in claim 1, wherein the driving member includes a gear on the developing roller shaft that protrudes outside of the housing and meshed with a first driving gear connected with a first driving motor disposed outside of the housing.

3. The process cartridge as claimed in claim 2, wherein the photosensitive body gear meshes with a second driving gear connected with the first driving motor.

4. The process cartridge as claimed in claim 2, wherein the photosensitive body gear meshes with a second driving gear connected with a second driving motor.

5. The process cartridge as claimed in claim 1, wherein the photosensitive body gear is connected with the developing driving part by at least one idle gear.

6. An image forming device, comprising:

an image forming device body having a first driving gear connected with a first driving motor;

a process cartridge including a photosensitive body unit including a photosensitive body and a photosensitive body driving part, the photosensitive body driving unit having a photosensitive body gear formed on a photosensitive body shaft, and an electrostatic latent image being formed on the photosensitive body;

a developing unit including a developing roller developing the electrostatic latent image and a developing driving part, the developing driving part having a developing roller gear formed on a developing roller shaft, the developing roller shaft being fixed at the housing by an adjustable supporting bracket such that a distance between the developing roller and the photosensitive body is adjustable; and a housing integrating the photosensitive body unit and the developing unit into a module, wherein the developing driving part includes a driving member protruding outside of the housing and being meshed with the first driving gear as the process cartridge is mounted to the image forming device body.

7. The device as claimed in claim 6, wherein the driving member includes a gear on the developing roller shaft protruding outside of the housing and meshing with the first driving gear.

8. The device as claimed in claim 6, wherein the photosensitive body gear is connected with a second driving gear transmitting a driving force from the first driving motor.

9. The device as claimed in claim 6, wherein the photosensitive body gear is connected with a second driving gear transmitting a driving force from a second driving motor.

10. The device as claimed in claim 6, wherein the photosensitive body gear is connected with the developing driving part by at least one idle gear.

11. A process cartridge of an image forming device, the process cartridge, comprising:

a photosensitive body unit including a photosensitive body; and a photosensitive body driving part, the photosensitive body driving part having a photosensitive body gear on a photosensitive body shaft, and an electrostatic latent image being formed on the photosensitive body;

a developing unit including a developing roller developing the electrostatic latent image; and a developing driving part, the developing driving part having a developing roller gear to drive a developing roller;

a housing integrating the photosensitive body unit and the developing unit into a single module; and a driving member of the developing driving part protruding outside of the housing and transmitting a driving force from the outside, wherein the developing roller protrudes outside of the housing and is connected to a first driving gear disposed of the housing, the developing roller gear and the first driving gear not being coaxially formed.

12. The process cartridge as claimed in claim 11, wherein the driving member includes a gear to drive the developing roller that protrudes outside of the housing and meshed with the first driving gear connected with a first driving motor disposed outside of the housing.

13. The process cartridge as claimed in claim 12, wherein the developing roller gear is fixed at the housing by a supporting bracket.

14. The process cartridge as claimed in claim 11, wherein the photosensitive body gear is connected with the developing driving part by at least one idle gear.

15. An image forming device, comprising:

an image forming device body having a first driving gear connected with a first driving motor;

a process cartridge including a photosensitive body unit including a photosensitive body and a photosensitive body driving part, the photosensitive body driving unit having a photosensitive body gear formed on a photosensitive body shaft, and an electrostatic latent image being formed on the photosensitive body;

a developing unit including a developing roller developing the electrostatic latent image and a developing driving part, the developing driving part having a developing roller gear to drive a developing roller, the developing roller gear and the first driving gear not being coaxially formed; and a housing integrating the photosensitive body unit and the developing unit into a module, wherein the developing driving part includes a driving member protruding outside of the housing and being meshed with the first driving gear as the process cartridge is mounted to the image forming device body.

16. The device as claimed in claim 15, wherein the driving member includes a gear to drive the developing roller protruding outside of the housing and meshing with the first driving gear.

17. The device as claimed in claim 16, wherein the developing roller gear is fixed at the housing by a supporting bracket.

18. The device as claimed in claim 15, wherein the photosensitive body gear is connected with the developing driving part by at least one idle gear.

* * * * *